US011939845B2

(12) United States Patent
Al Harthi

(10) Patent No.: US 11,939,845 B2
(45) Date of Patent: Mar. 26, 2024

(54) CATCHING DROPPED TUBULARS

(71) Applicant: Saudi Arabian Oil Company, Dhahran (SA)

(72) Inventor: Amer Hamoud Al Harthi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/315,329

(22) Filed: May 10, 2023

(65) Prior Publication Data

US 2023/0279740 A1 Sep. 7, 2023

Related U.S. Application Data

(62) Division of application No. 17/532,763, filed on Nov. 22, 2021, now Pat. No. 11,686,179.

(51) Int. Cl.
*E21B 40/00* (2006.01)
*E21B 3/04* (2006.01)

(52) U.S. Cl.
CPC ..... *E21B 40/00* (2013.01)

(58) Field of Classification Search
CPC ... E21B 3/04; E21B 3/045; E21B 3/06; E21B 19/10; E21B 19/102
See application file for complete search history.

(56) References Cited

U.S. PATENT DOCUMENTS

| | | | | |
|---|---|---|---|---|
| 224,532 | A * | 2/1880 | Heme | E21B 19/10 188/67 |
| 644,638 | A * | 3/1900 | Rhodes | E21B 3/04 464/166 |
| 717,630 | A | 1/1903 | Seed | |
| 775,417 | A | 11/1904 | Chapman | |
| 1,044,349 | A * | 11/1912 | Chapman | E21B 3/04 464/166 |
| 1,058,577 | A * | 4/1913 | Gardner | E21B 19/10 188/67 |
| 1,101,483 | A | 6/1914 | Chapman | |
| 1,113,132 | A | 10/1914 | McAllister | |
| 1,422,289 | A | 7/1922 | Moody | |
| 1,442,663 | A * | 1/1923 | Halley | E21B 19/10 188/67 |
| 2,215,047 | A | 9/1940 | Marshall | |
| 2,564,119 | A | 8/1951 | Matthews | |
| 2,987,822 | A | 6/1961 | Arps | |
| 4,676,312 | A | 6/1987 | Mosing et al. | |
| 7,367,403 | B2 | 5/2008 | Webre et al. | |
| 7,669,662 | B2 | 3/2010 | Pietras | |
| 2006/0000600 | A1 * | 1/2006 | Pietras | E21B 19/24 166/77.52 |
| 2014/0353997 | A1 | 12/2014 | Fox | |
| 2021/0215005 | A1 | 7/2021 | Jahn et al. | |

* cited by examiner

*Primary Examiner* — Kipp C Wallace
(74) *Attorney, Agent, or Firm* — Fish & Richardson P.C.

(57) ABSTRACT

A rotatable plate is configured to be coupled to a rotary table of a rig floor. The rotatable plate defines a central passage through which a tubular can be passed. Multiple arms each have a first end rotably coupled to the rotatable plate. The arms are hinged such that a distal end of the arms, away from the rotatable plate, are configured to move towards or away from the passage. Each of arms extends away from the rotatable plate towards the passage. The arms are biased away from the passage. Rollers are rotably coupled to one of the distal ends of the arms.

5 Claims, 7 Drawing Sheets

CATCHING DROPPED TUBULARS

CROSS-REFERENCE TO RELATED PATENT APPLICATIONS

This application is a divisional of U.S. patent application Ser. No. 17/532,763, filed Nov. 22, 2021, the contents of which are incorporated by reference herein.

TECHNICAL FIELD

This disclosure relates to catching piping strings on rigs.

BACKGROUND

During wellbore operations, such as tripping tubing, piping, or casing into a wellbore, tubulars are lowered into the wellbore and restrained while an additional tubular is attached to the tubular string. In such situations, the string is restrained by a hydraulic spider. A hydraulic spider defines a passage through which the tubular sections are passed. The spider includes hydraulic "legs" that extend into the opening to support and restrain the tubular string.

SUMMARY

This specification describes technologies relating to catching dropped tubulars.

An example of the subject matter described within this disclosure is a rig safety device with the following features. A rotatable plate is configured to be coupled to a rotary table of a rig floor. The rotatable plate defines a central passage through which a tubular can be passed. Multiple arms each have a first end rotably coupled to the rotatable plate. The arms are hinged such that a distal end of the arms, away from the rotatable plate, are configured to move towards or away from the passage. Each of arms extends away from the rotatable plate towards the passage. The arms are biased away from the passage. Rollers are rotably coupled to one of the distal ends of the arms.

Aspects of the example rig safety devices, which can be combined with the rig safety device alone or in combination with other aspects, include the following. The rotatable plate defines a plurality of grooves corresponding to each of the plurality of rollers. The grooves are sized to receive the rollers.

Aspects of the example rig safety devices, which can be combined with the rig safety device alone or in combination with other aspects, include the following. The rollers and the rotatable plate include carbon steel.

Aspects of the example rig safety devices, which can be combined with the rig safety device alone or in combination with other aspects, include the following. The rollers include four rollers.

Aspects of the example rig safety devices, which can be combined with the rig safety device alone or in combination with other aspects, include the following. The arms include twice the number of rollers.

Aspects of the example rig safety devices, which can be combined with the rig safety device alone or in combination with other aspects, include the following. The angle bias further includes an angle bias biasing an angle of each of the plurality of arms relative to the rotatable plate.

Aspects of the example rig safety devices, which can be combined with the rig safety device alone or in combination with other aspects, include the following. Each of the arms includes a cylinder nearer the rotatable plate than the distal end. A pin is at the distal end of the arm. The pin is radially retained by the cylinder. An axial bias biases the pin away from the cylinder.

Aspects of the example rig safety devices, which can be combined with the rig safety device alone or in combination with other aspects, include the following. The axial bias includes a coiled metal spring.

Aspects of the example rig safety devices, which can be combined with the rig safety device alone or in combination with other aspects, include the following. A surface of the roller includes a rough texture.

An example implementation of the subject matter described by this disclosure is a method of catching a dropped vertical tubular. The method has the following features. A clamp, carried by a tubular, is contacted by a roller, as a tubular on which the clamp is attached falls at an uncontrolled rate. The roller is guided by the clamp towards a rotatable plate supporting the roller in response to contacting the clamp. The rotatable plate interferes with the roller and the clamp in response to guiding the roller. The uncontrolled fall is ceased in response to interfering with the roller and the clamp.

Aspects of the example method, which can be combined with method alone or in combination with other aspects, include the following. The clamp is received by the tubular.

Aspects of the example method, which can be combined with method alone or in combination with other aspects, include the following. The tubular is removed from the roller and rotatable plate after the uncontrolled fall has been ceased.

Aspects of the example method, which can be combined with method alone or in combination with other aspects, include the following. The tubular is a first tubular. The clamp is a first clamp. The method further includes the following features. The clamp is removed from the first tubular. The first tubular is lowered in a controlled manner. A second tubular is received by the first tubular. The clamp, or a second, identical clamp, is received by the second tubular.

Aspects of the example method, which can be combined with method alone or in combination with other aspects, include the following. The rollers are bound by a rough surface of the rollers and a rough surface of the rotatable plate.

An example implementation of the subject matter described within this disclosure is a rig system with the following features. A clamp is attached to and encircles a vertical tubular. A rotary table defines a portion of a passage through which the tubular is passed. A catching device is above and supported by the rotary table. The catching device is configured to rotate in unison with the rotary table. The catching device includes the following features. A rotatable plate defines a second portion of the passage through which the tubular is passed. Arms extend away from the rotatable plate towards the passage. The arms are biased away from the passage. The arms are hinged such that a distal end of each of the arms, away from the rotatable plate, is configured to move towards or away from the passage. Rollers are at distal ends of the arms. Each of the rollers is supported by two of the plurality of arms.

Aspects of the example rig system, which can be combined with example rig system alone or in combination with other aspects, include the following. The rotatable plate defines grooves corresponding to each of the plurality of rollers. The grooves are sized to receive the rollers.

Aspects of the example rig system, which can be combined with example rig system alone or in combination with other aspects, include the following. The rollers and the rotatable plate include carbon steel.

Aspects of the example rig system, which can be combined with example rig system alone or in combination with other aspects, include the following. The rollers include four rollers.

Aspects of the example rig system, which can be combined with example rig system alone or in combination with other aspects, include the following. An angle bias biases an angle of each of the arms relative to the rotatable plate. The angle bias includes a coiled metal spring.

Aspects of the example rig system, which can be combined with example rig system alone or in combination with other aspects, include the following. Each of the arms includes the following features. A cylinder is nearer the rotatable plate than the distal end. A pin is at the distal end of the arm. The pin is radially retained by the cylinder. An axial bias biases the pin away from the cylinder.

Aspects of the example rig system, which can be combined with example rig system alone or in combination with other aspects, include the following. The axial bias includes a coiled metal spring.

Particular embodiments of the subject matter described in this specification can be implemented so as to realize one or more of the following advantages. The subject matter allows tubulars to be caught during uncontrolled drops. Catching the tubulars prior to the tubulars falling fully into the wellbore prevents delays in wellbore operations.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

During tripping operations, a tubular can sometimes be dropped in an uncontrolled manner. This results in a tubular falling into a wellbore, requiring extensive fishing operations to retrieve the dropped string. The fishing operations can extend wellbore operations significantly, causing delays. The spider does not actuate quickly enough to catch and restrain the tubular when such a situation presents itself.

This disclosure relates to a tubular safety device on a rig floor. The device includes spring loaded arms with rollers. The arms are pivotable towards a hole in the rig floor through which tubulars are fed. The tubulars include a removable safety clamp. In instances where the tubular is dropped, the rollers interfere with the removable safety clamp to catch the dropped tubular.

Figure 1:
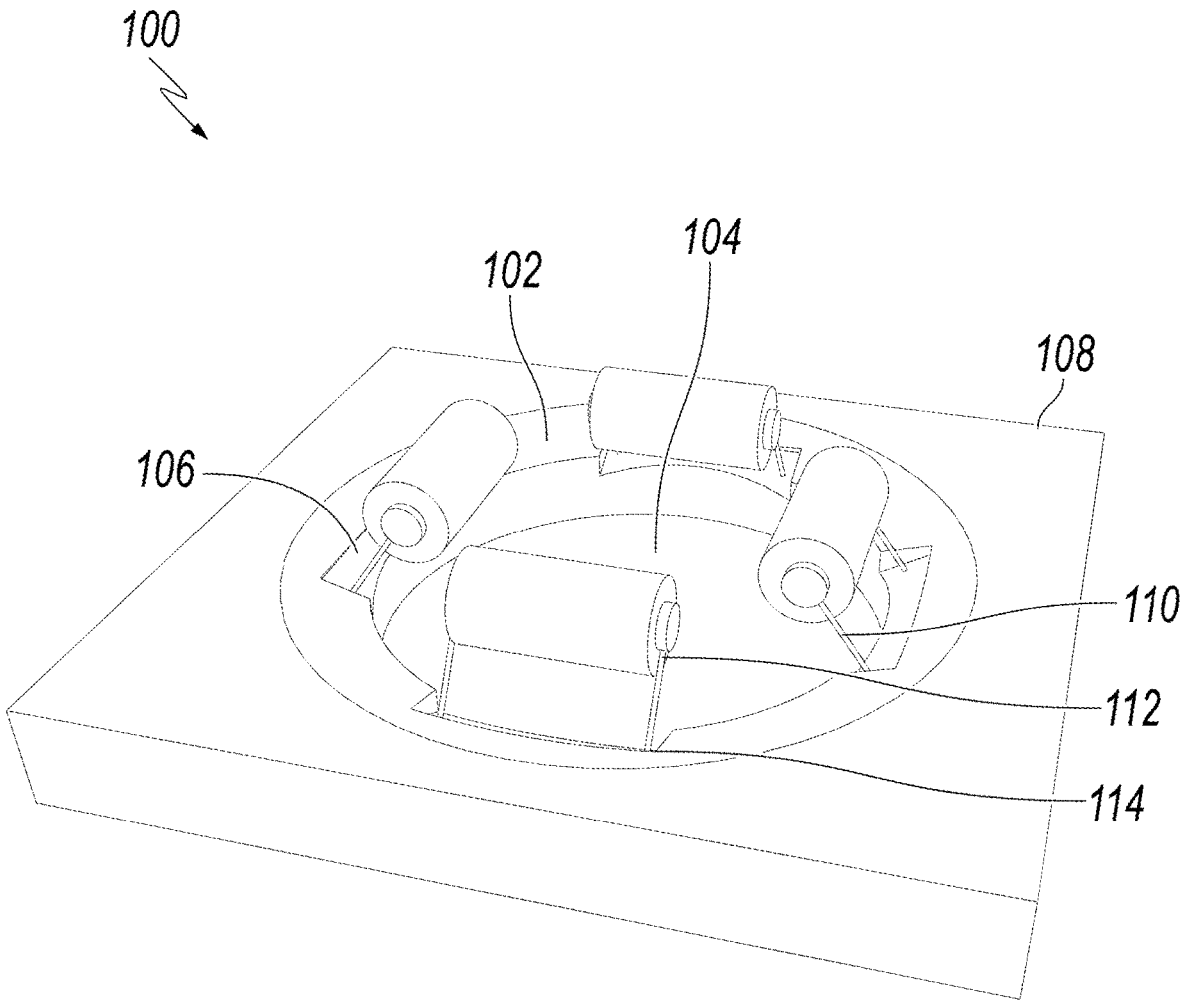
FIG. 1 is a perspective view of an example rig safety device.

FIG. 1 is a perspective view of an example rig safety device 100. The rig safety device 100 includes a rotatable plate 102 configured to be coupled to a rotary table of a rig floor. The rotatable plate 102 defines a central passage 104 through which a tubular, such as casing, can be passed. The rotatable plate 102 defines a plurality of grooves 106 corresponding to each of the rollers 108. The grooves are sized to receive the rollers 108. That is, the grooves 106 are dimensionally (length and width) large enough to receive the rollers 108 during a drop scenario.

The rollers 108 are connected to the rotatable plate 102 by arms 110 each having a first end 114 rotably coupled to the rotatable plate 102. Each of the arms 110 is hinged such that a distal end 112 of the arms 110, that is, ends away from the rotatable plate, are configured to move towards the central passage 104 or away from the passage 104. Each of the arms 110 extend away from the rotatable plate. In some implementations, the arms extend towards the central passage 104. The arms 110 are biased away from the central passage 104. Additional details on the arms 110 are described throughout this disclosure.

The rollers 108 are rotably coupled to the distal ends 112 of the arms 110. In the illustrated implementation, the rig safety device includes four rollers 108 with two arms 110 supporting each roller 108. Other numbers of rollers 108 and arms 110 per roller can be used without departing from this disclosure. For example, two, three, or five rollers 108 can be used without departing from this disclosure. For arms 110, one or three arms 110 can be used with each roller, for example, without departing from this disclosure.

Components within the rig safety device 100 are constructed of robust materials, such as carbon steel. The components within the rig safety device, such as the rollers 108 and the rotatable plate 102, can endure a number of dropped tubulars before being replaced. For example, the components can be rated to sustain four drops.

Figure 2:
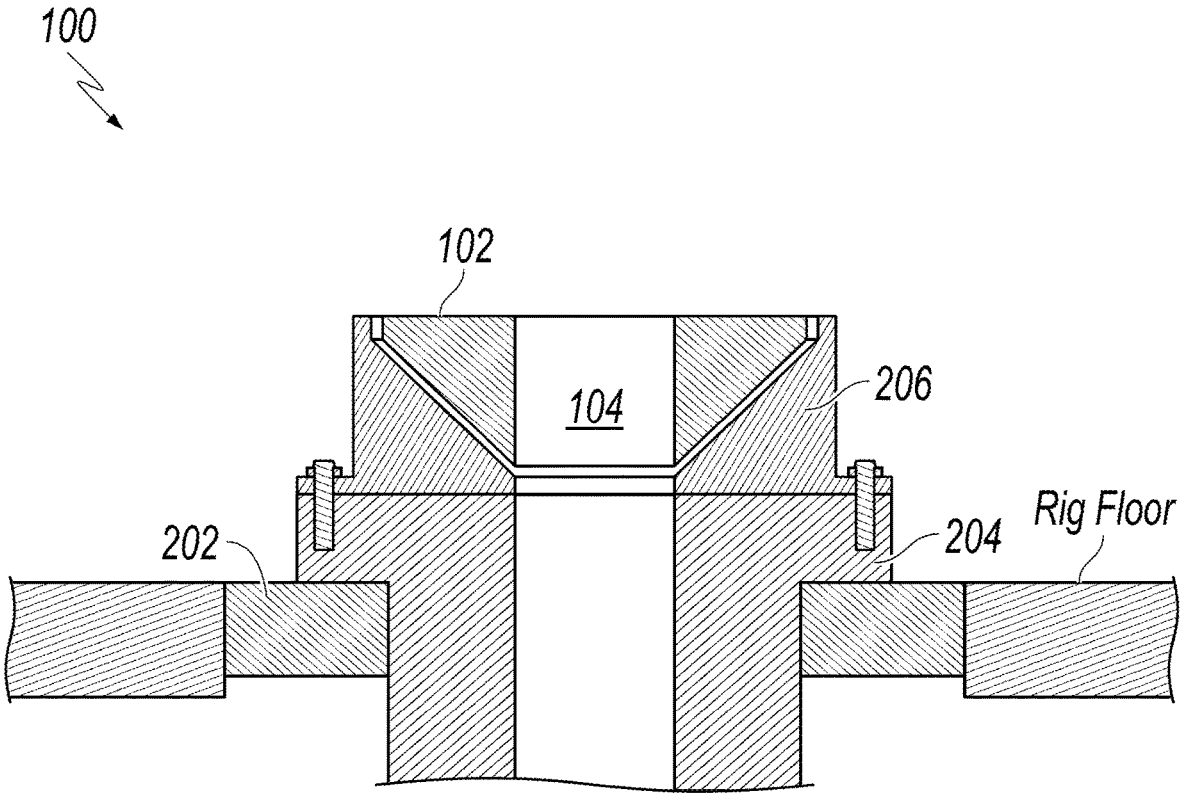
FIG. 2 is a side cross-sectional schematic diagram of an example rotary table with the example rig safety device installed.

FIG. 2 is a side cross-sectional schematic diagram of an example rotary table 202 with the example rig safety device 100 installed. The rotary table 202 defines a second portion of a passage 104 through which the tubular is passed. The rig safety device 100 is coupled to the rotary table 202, by the flush-mounted spider 204. In some implementations, the rig safety device is fastened to the flush-mounted spider 204, for example, with bolts. The flush-mounted spider 204 defines a third portion of the passage 104 through which the tubular is passed. The rig safety device 100, the flush-mounted spider 204, and the rotary table 202 are arranged to rotate in unison with one another. The rig safety device 100 itself includes a body 206 in which the tapered rotatable plate 102 rests and is centered.

Figure 3A:
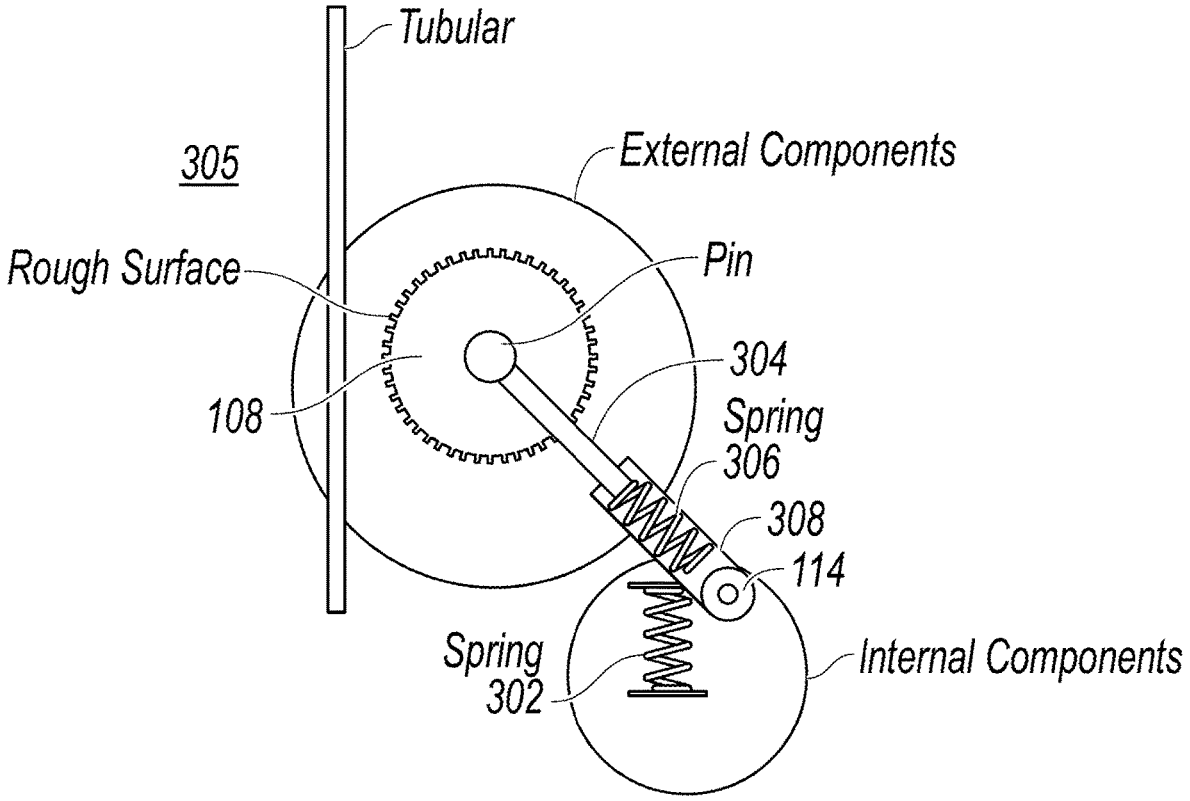
FIG. 3A is a side cross-sectional view of an example roller and arm of the example rig safety device.

FIG. 3A is a side cross-sectional view of an example roller 108 and arm 110 of the example rig safety device 100 (FIG. 1). The arm includes an angle bias 302 pivotally biasing the arm 110 away from the opening configured to receive the tubular 305. In some implementations, the angle bias 302 is a metal spring. Other biases can be used without departing from this disclosure, for example, a torsion spring, a compression spring, a tension spring, an air spring, or an elastomer spring.

Each of the arms 110 themselves are made up of a variety of components. For example, a cylinder is nearer the rotatable plate 102 (FIG. 1) than the distal end 112. In some implementations, the cylinder can include the hinged end 114. At the distal end of the cylinder is a pin 304. The pin 304 is radially retained by the cylinder 306. In some implementations, the pin 304, the cylinder 306, or both can include a shoulder, tab, or other interference geometry to retain an end of the pin 304 within the distal end of the cylinder 306. The pin 304 itself is at the distal end of the arm 110.

The cylinder 306 itself defines a chamber in which an axial bias 308 biases the pin 304 away from the cylinder 306. In some implementations, the axial bias 308 includes a coiled metal compression spring. Other biases can be used without departing from this disclosure, for example, a torsion spring, a compression spring, a tension spring, an air spring, or an elastomer spring.

The roller 108 is connected to one or more pins 304 by a retaining pin. This pin radially retains the roller while the arms axially constrain the roller 108. In some implementations, each of the rollers includes a rough textured surface. In some implementations, the grooves can include a similar rough texture. In such implementations, the rollers may bind with the texture in the grooves to prevent rolling during catching operations.

Figure 3B:
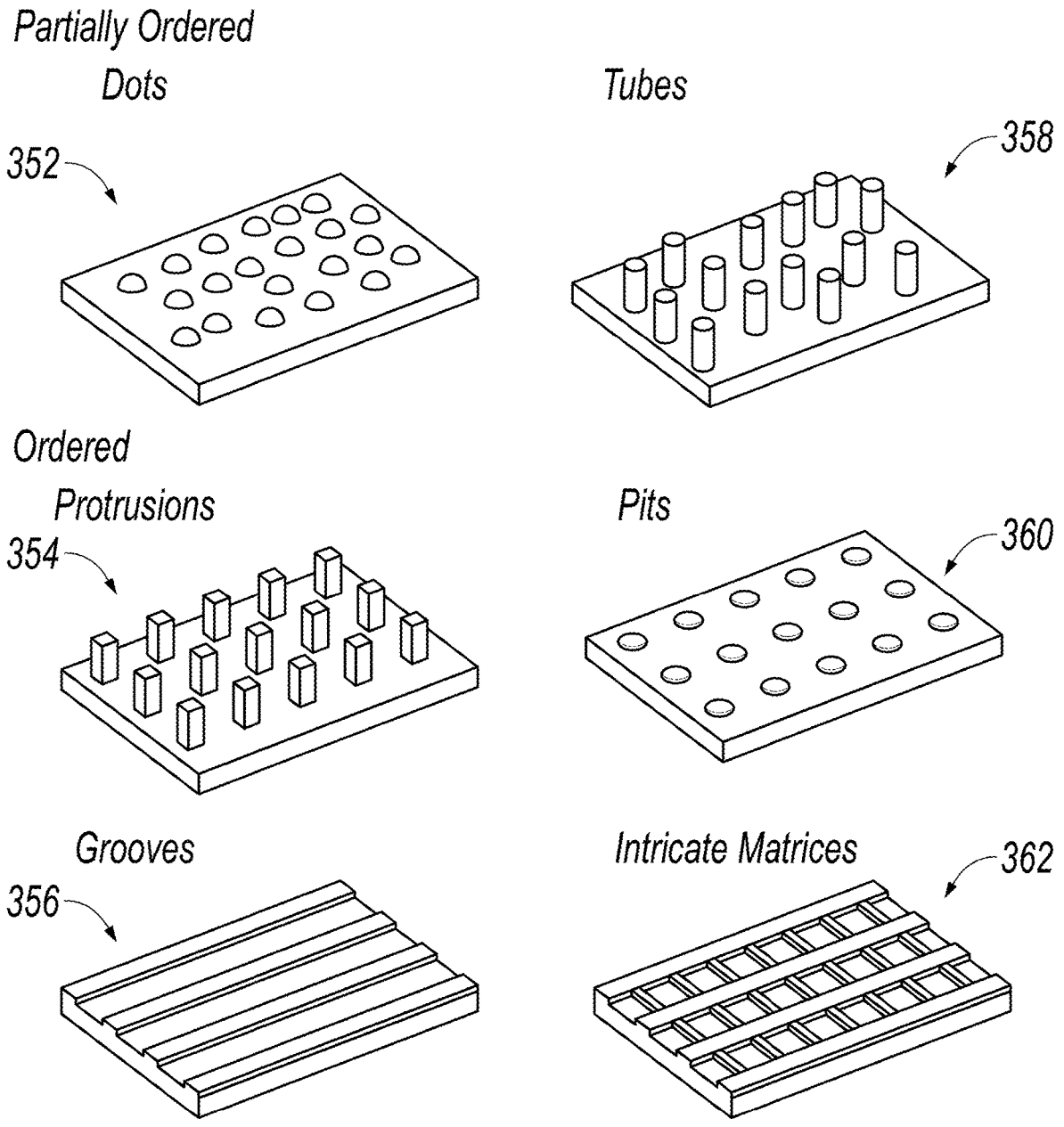
FIG. 3B are examples of rough surfaces that can be used on the roller or grooves of a rotatable plate of the example rig safety device.

FIG. 3B illustrates examples of rough surfaces that can be used on the roller 108 or grooves 106 of a rotatable plate 102 of the example rig safety device 100. Rough surface 352 includes raised dots extending from the surface. Rough surface 354 includes protrusions extending from the surface. These protrusions have a height greater than that of the dots of surface 352. Rough surface 356 includes grooves. In some implementations, the grooves extend perpendicular to the direction of rotation of the rollers ###. Rough surface 358 includes lengths of tubes extending from the surface. Rough surface 360 is a surface with negative features, that is, material is removed from the surface to define pits. Rough surface 362 includes an intricate matrix. The intricate matrix is similar to the grooves of surface 356; however, material is removed perpendicular to the grooves to produce a grid-like surface. All of the rough surfaces described herein can be manufactured and added to components in a variety of ways, for example, additive manufacturing techniques, such as weld overlay or 3D printing, or traditional machining techniques, such as milling. Alternatively or in addition, surface components can be added to existing surfaces, for example, the protrusions of surface 354 or the tubes of surface 385 can be welded, epoxied, or otherwise fastened to a surface of a component.

Figure 4:
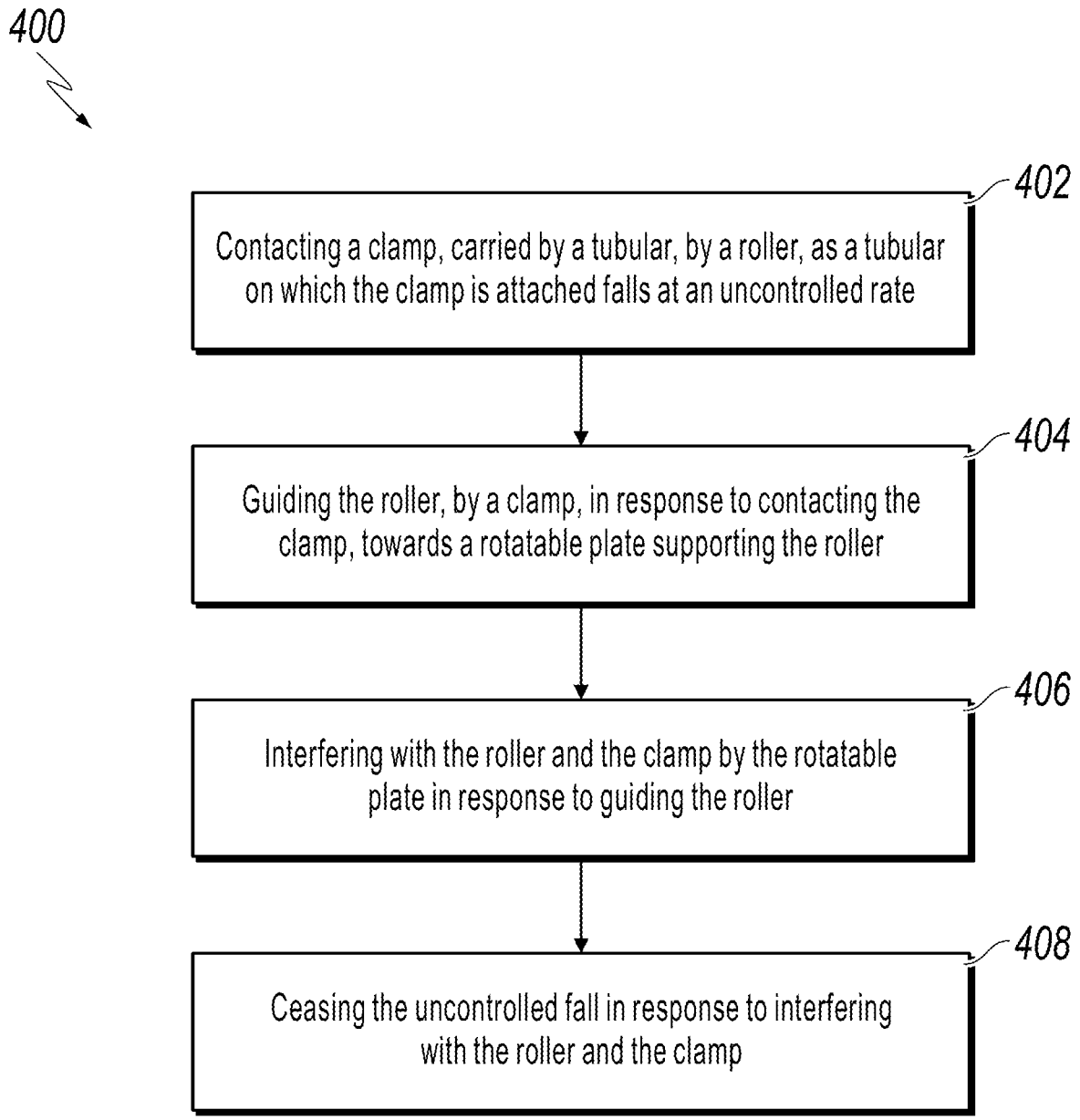
FIG. 4 is a flowchart of an example method that can be used with aspects of this disclosure.
Figure 5A:
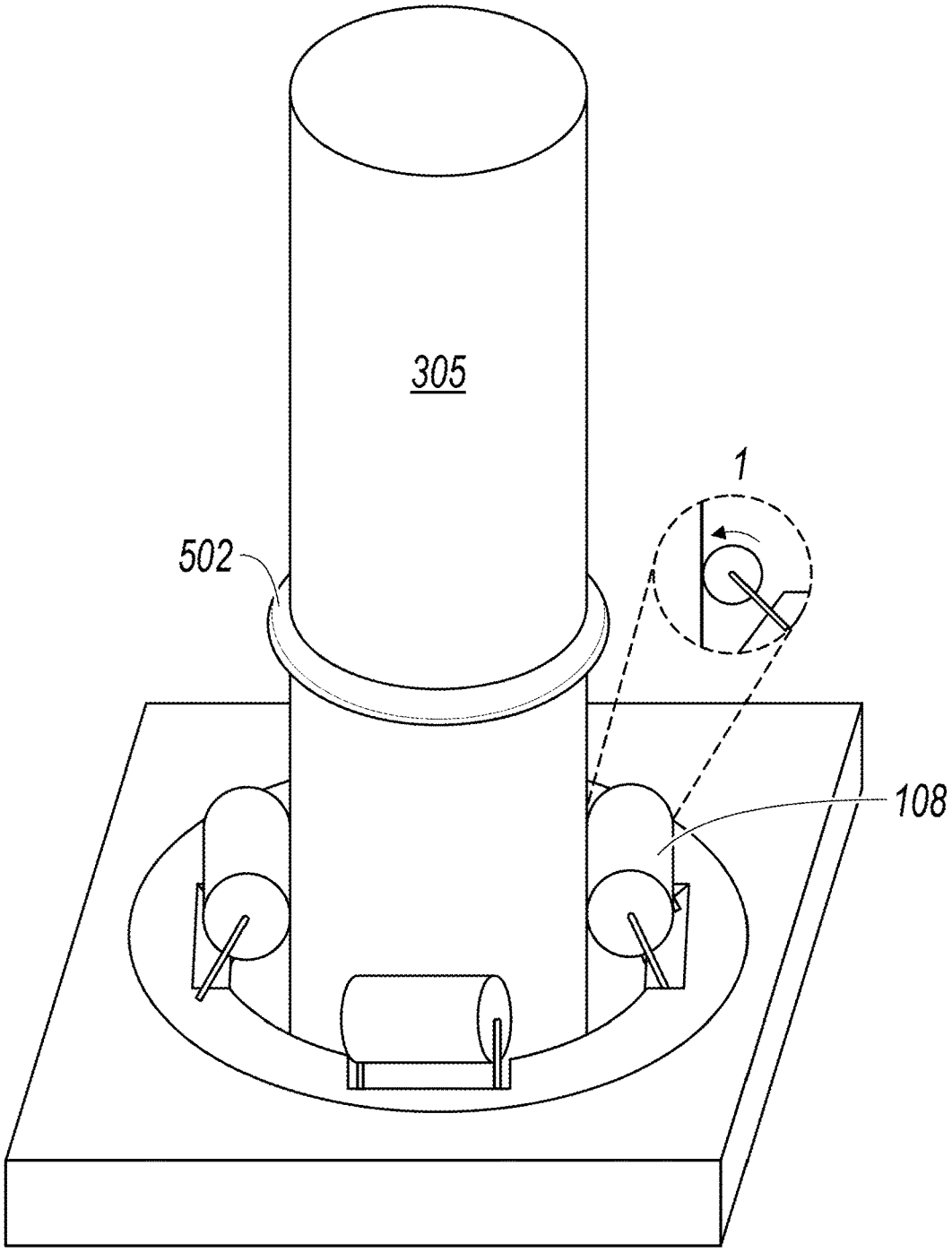
FIGS. 5A-5B are perspective views of the example rig safety device in various stages of operation.
Figure 5B:
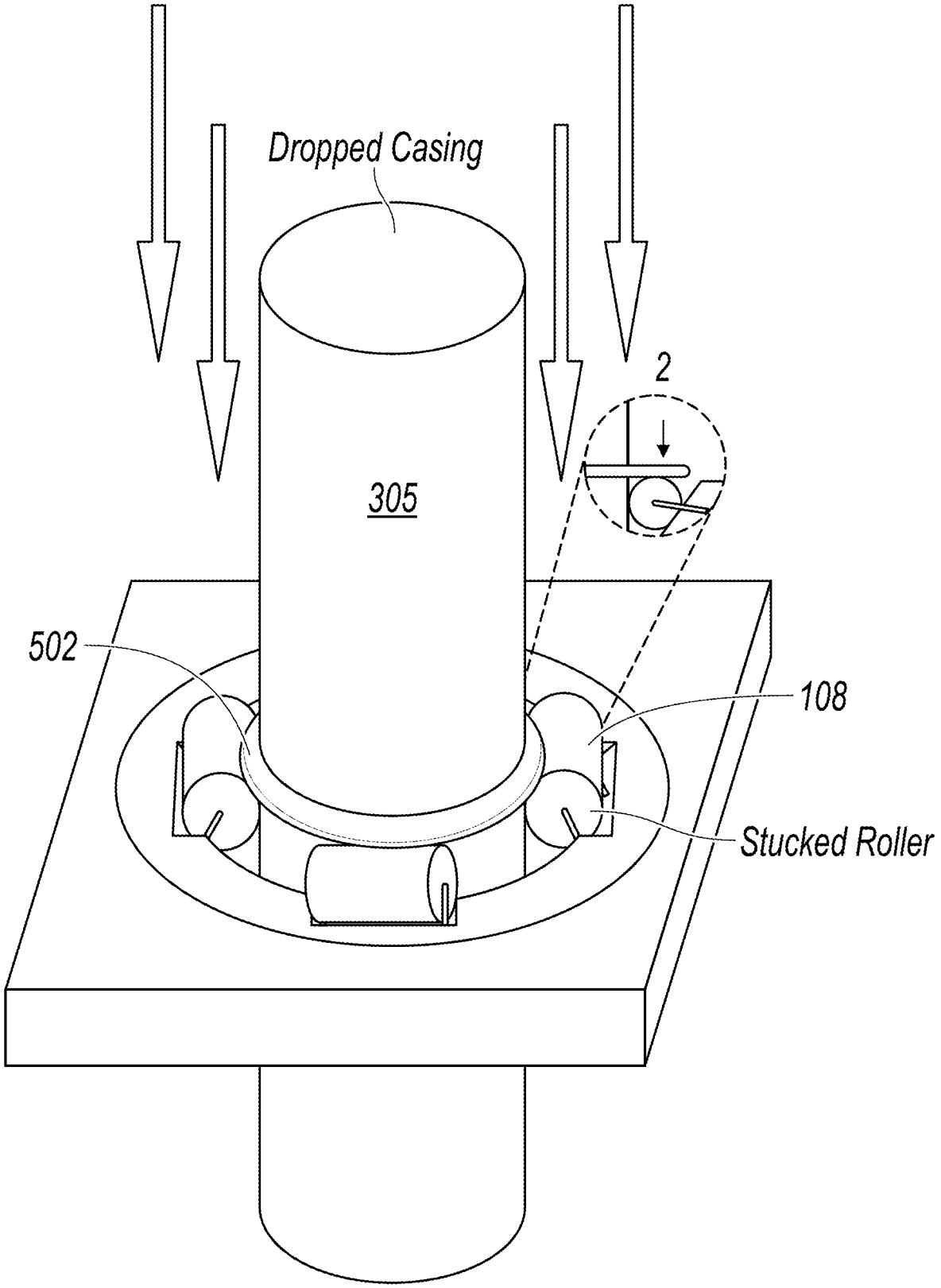

FIG. 4 is a flowchart of an example method 400 that can be used with aspects of this disclosure. The flowchart is discussed in context with FIGS. 5A-5B, which are perspective views of the example rig safety device in various stages of operation.

In the illustrated scenario, a vertical tubular is being passed through the rig safety device 100. Prior to inserting the tubular through the rig safety device 100, a clamp 502 is received by and encircles the tubular 305. Several types of clamps can be used without departing from this disclosure. For example, a T-type clamp, a C-type clamp, or an MP-type clamp can be used.

In instances where the tubular is dropped, at 402, the clamp 502, carried by the tubular 305, is contacted by the rollers 108. That is, when the tubular falls at an uncontrolled rate, the clamp makes contact with the rollers. At 404, the roller 108 is guided by the clamp 502 towards the rotatable plate 102 in response to contact with the clamp 502. In some implementations, the clamp 502 guides the roller into the grooves 106. At 406, the rotatable plate 102 interferes with (blocks) the roller 108 and the clamp 502 in response to guiding the roller 108. At 408, the uncontrolled fall is ceased in response to interfering with the roller 108 and the clamp 502. After the uncontrolled fall has been ceased, the tubular 305 is removed from the rollers 108 and rotatable plate 102.

Under normal operations, the clamp 502 is removed from the tubular 305 once the tubular 305 has been lowered through the passage 104 to a desired depth. A second tubular is then received by an uphole end of the first tubular 305. The clamp or a second, identical clamp, is then received by the second tubular, and the process is repeated.

While this specification contains many specific implementation details, these should not be construed as limitations on the scope of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method of catching a dropped vertical tubular, the method comprising:

contacting a clamp, carried by a tubular, by a roller, as the tubular on which the clamp is attached falls at an uncontrolled rate;

guiding the roller, by the clamp, in response to contacting the clamp, towards a rotatable plate supporting the roller;

interfering with the roller and the clamp by the rotatable plate in response to guiding the roller; and ceasing the uncontrolled fall in response to interfering with the roller and the clamp.

2. The method of claim 1, further comprising receiving the clamp by the tubular.

3. The method of claim 1, further comprising removing the tubular from the roller and rotatable plate after the uncontrolled fall has been ceased.

4. The method of claim 1, wherein the tubular is a first tubular, wherein the clamp is a first clamp, the method further comprising:

removing the clamp from the first tubular;

lowering the first tubular in a controlled manner;

receiving a second tubular by the first tubular; and receiving the clamp, or a second, identical clamp, by the second tubular.

5. The method of claim 1, further comprising binding the rollers by a rough surface of the rollers and a rough surface of the rotatable plate.

* * * * *